United States Patent [19]

Hagar

[11] 3,972,348

[45] Aug. 3, 1976

[54] TEMPERATURE COMPENSATING VALVE ASSEMBLY

[75] Inventor: Donald K. Hagar, Allentown, Pa.

[73] Assignee: Mosser Industries, Inc., Allentown, Pa.

[22] Filed: June 12, 1975

[21] Appl. No.: 586,519

[52] U.S. Cl. ..... 137/601; 98/110

[51] Int. Cl.[2] ..... F23L 13/08

[58] Field of Search ..... 137/601; 98/110

[56] References Cited

UNITED STATES PATENTS

| | | | |
|---|---|---|---|
| 3,084,715 | 4/1963 | Scharres | 137/601 |
| 3,426,507 | 2/1969 | Kossowski | 137/601 X |
| 3,443,588 | 5/1969 | Banko | 137/601 |
| 3,525,328 | 8/1970 | Crudden | 137/601 X |
| 3,604,458 | 9/1971 | Silvey | 137/601 |
| 3,696,804 | 10/1972 | Paredes | 137/601 X |
| 3,783,768 | 1/1974 | Caming et al | 98/110 |

*Primary Examiner*—Robert G. Nilson
*Attorney, Agent, or Firm*—Morton, Bernard, Brown, Roberts & Sutherland

[57] ABSTRACT

A valve assembly comprising a housing constructed of a material which will expand when heated, a plurality of closure elements inside the housing that can be rotated between valve open and valve closed positions, each element being mounted on its own shaft that is journaled in the housing and that has an external end portion extending through the housing with the shafts being parallel to one another and lying in the same plane at equidistant intervals, a plurality of cranks of equal length extending radially from the end portion of each shaft for rotating the shaft, and drive arm means linking the plurality of cranks so that rotation of one of the cranks causes all of the cranks, shafts, and elements to rotate in unison is improved by the drive arm means being temperature-compensating three-link mechanisms connecting each of the cranks and comprising (a) a first floating link pivotally attached at its first end to the non-shaft end of one of the cranks, (b) a second floating link of the same length as the first and pivotally attached at its first end to the non-shaft end of the next adjacent crank and (c) a rotating link pivotally mounted at its center to the housing at a point in the plane of the shafts that is equidistant between the adjacent shafts and pivotally connected at one end to the second end of one of the floating links and pivotally connected at its other end to the second end of the other floating link.

6 Claims, 3 Drawing Figures

TEMPERATURE COMPENSATING VALVE ASSEMBLY

This invention relates to an improved linkage arrangement for multiple closure element valve assemblies particularly adapted to control the flow of fluids subject to high temperatures wherein three-link drive arm means are employed to rotate the closure elements in unison between valve open and valve closed positions and to maintain the closure elements in a fixed position regardless of expansion and contraction in the valve assembly due to temperature changes therein.

Multiple closure element valve assemblies, such as multiple louver valves, are commonly utilized in power plants to control the flow of high velocity flue gases at high temperatures, such as oil ash, coal ash, saturated acid flue gas and electric arc furnace off gas, through duct openings, as for example suspended hot gas ducts from furnace plenums. The multiple closure element valve assembly which is usually employed in regulating these hot gases comprises a housing constructed of a material that will expand upon heating, a plurality of closure elements inside the housing that can be rotated between valve open and valve closed positions, each element being mounted on its own shaft that is journaled in the housing and has an external end portion extending through the housing with the shafts being parallel to one another and lying in the same plane at equidistant intervals, a plurality of cranks of equal length extending radially from the end portion of each shaft for rotating the shaft, and drive arm means linking the plurality of cranks together so that rotation of one of the cranks causes all of the cranks, shafts, and elements to rotate in unison. In this valve assembly construction, the closure elements are formed side by side with the linkage arrangement disposed at the ends of the cranks for simultaneous adjustment of the closure elements so that the closure elements regulate the flow of gases continuously from substantially complete cessation of such flow to the maximum rate possible under the available pressure differentials. However, when multiple closure element valve assemblies are operated under high temperature conditions, the valve position changes from its desired setting as the temperature of the housing changes. As the housing heats up to the temperature of the gases within the duct or as the temperature of the gases increases, the housing expands in the plane of the shafts and the shafts move apart. For example, where a 1000°F. flue gas passes through this type of multiple closure element valve assembly, a one-eighth inch expansion of a two-foot separation between the shafts at room temperature has been observed. As the housing expands, the drive arm means connecting the ends of the cranks do not expand at all or expand at a slower rate since the drive arm means are further away from the hot gases than the housing by the length of the exterior end portions of the shafts and are always at a temperature which is lower than that of the housing where the shafts are journaled. As the shafts move apart upon expansion of the housing or move closer upon contraction of the housing, the cranks rotate to allow the drive arm means to span the increased or decreased distance between the shafts. Thus, the valve assembly may be adjusted so that the closure elements are in the desired positions at any one temperature but the closure elements will move from their desired positions during expansion and contraction as the housing heats up or cools down or as the temperature of the gases changes.

The present invention provides an improved drive arm means to link the cranks in high temperature multiple closure element valve assemblies for rotation in unison that compensates for differential thermal expansion and contraction in the housing and drive arm means and provides precise regulation of the flow of hot gases. The improvement resides in the use of three-link drive arm means to connect adjacent cranks which comprises a first floating link pivotally attached at its first end to the non-shaft end of one of the cranks, a second floating link of the same length as the first and pivotally attached at its first end to the non-shaft end of the next adjacent crank and a rotating link pivotally mounted at its center to the housing at a point in the plane of the shafts with one end of the rotating link being pivotally connected to the second end of one of the floating links and the other end of the rotating link being pivotally connected to the second end of the other floating link. With the linkage arrangement of the present invention, the rotating link rotates as the cranks rotate or as the shafts move apart or closer during periods of expansion and contraction of the housing. The rotating link rotates and the floating links pivot in accordance with the thermal expansion and contraction of the housing, while the cranks remain in the same position as the shafts move so that the closure elements are maintained in the desired positions during periods of expansion and contraction. The linkage arrangement thus compensates for the differential in thermal expansion and contraction between the housing and the links connecting the cranks external to the housing.

The linkage arrangement of the present invention may be used with a variety of types of multiple closure element valve assemblies. In the preferred embodiment shown in the drawings, the drive arm means is used in a multiple louver valve in a single flow path. The linkage may also be used in a valve assembly comprising a series of single closure element valves which may be round butterfly valves, single louver valves or any other conventional type of valve disposed in separate flow paths so that the closure elements are mounted on parallel shafts lying in the same plane at equidistant intervals with each shaft having a crank of equal length extending radially from the end portion of the shaft. Conventional modifications as necessary may be made in the housing to provide a point equidistant between the shafts for mounting the rotating link. The drive arm means of this invention in these embodiments provides an efficient and dependable linkage arrangement for simultaneous adjustment of the valves in the different flow paths and will compensate for any expansion of the housing in the plane of the shafts.

The above and other advantages, features and characteristics of the invention are described in further detail in the following detailed description throughout which reference is had to the accompanying drawings in which FIG. 1 is a perspective view of a rectangular, three-closure element valve assembly of this invention showing the closure elements in a closed position.

Figure 1:
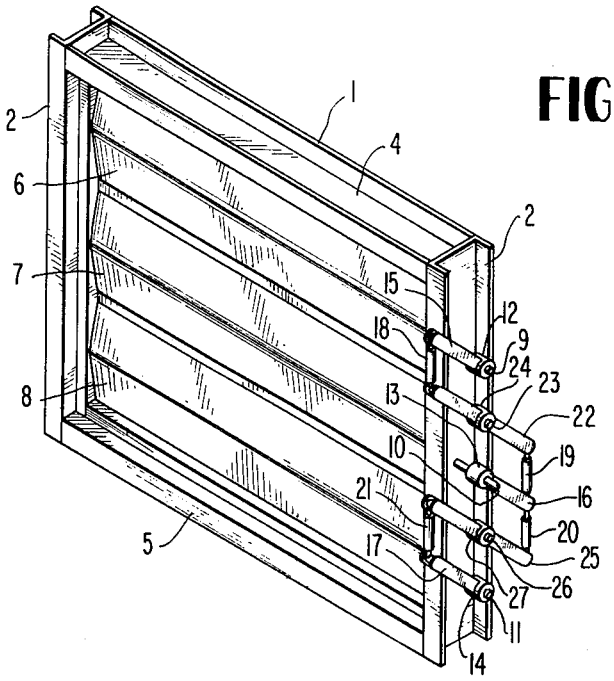

The rectangular, three-closure element valve assembly shown in the drawings has a housing 1 constructed of metal or any other material which expands upon heating. Housing 1 comprises spaced parallel vertically disposed side members 2 and 3 connected at their upper and lower ends by top and bottom members 4 and 5. Frame members 2, 3, 4 and 5 may be joined in any suitable manner as by welding to form a rigid rectangular structure adapted to be fitted into a duct or other passage (not shown). In the preferred embodiment shown in the drawings, frame members 2, 3, 4 and 5 are flanged channels but may be plate weldments of comparable thickness.

Three closure elements 6, 7 and 8 extend longitudinally across housing 1 and are individually secured to shafts 9, 10 and 11. As shown in the drawings, closure elements 6, 7 and 8 are preferably stressed skin airfoils with full welded seams and no external ribs and have overlapping portions so that the flow path through the valve assembly is completely shut off in the closed position.

Shafts 9, 10 and 11 extend through the ends of closure elements 6, 7 and 8 and are journaled at equal distances in side member 2 of housing 1 and in side member 3 of housing 1 so that shafts 9, 10 and 11 and closure elements 6, 7 and 8 rotate about spaced parallel axes between valve open and valve closed positions. The shafts may be sealed, for example, with gas tight packing glands (not shown). Shafts 9, 10 and 11 each have an external end portion on one end that extends through side member 2 of housing 1 to allow the attachment thereon in sleeve bearings 12, 13 and 14 of cranks 15, 16 and 17 for rotating each shaft. Cranks 15, 16 and 17 of equal length are rigidly secured to and extend radially from the external end portions of shafts 9, 10 and 11 respectively in alternating opposite parallel directions.

Three-link drive arm means couple the ends of adjacent cranks 15 and 16 and 16 and 17 so that rotation of one of the cranks causes all of the cranks, shafts and closure elements to rotate in unison. The three-link drive arm means connecting cranks 15 and 16 comprises two floating links 18 and 19 of the same length and a rotating link 22. Rotating link 22 is pivotally mounted at its center in a sleeve bearing 24 on a shaft 23 which is journaled in side member 2 of housing 1 at a point in the plane of shafts 9, 10 and 11 that is equidistant between adjacent shafts 9 and 10 to permit rotation of rotating link 22 about the centerline of shaft 23. Floating links 18 and 19 each have a first end pivotally attached to the non-shaft ends of cranks 15 and 16 respectively. Rotating link 22 is pivotally connected at one end to the second end of floating link 18 and at its other end to the second end of floating link 19. In like manner, a three-drive arm means comprising floating links 20 and 21 and a rotating link 25 pivotally mounted at its center in a sleeve bearing 27 on a shaft 26 couples cranks 16 and 17. Shafts 23 and 26 may be sealed, for example, with gas tight packing glands (not shown). Rotating links 22 and 25 are parallel to cranks 15, 16 and 17 and, preferably, each is equal to twice the length of each crank. In the preferred embodiment shown in the drawings, each of the cranks and floating links is equal in length.

Any conventional operating handle such as a control lever or control wheel, with a manual or powered drive means, may be attached directly or through a gauge indicating the valve position to the exterior end portion of any one of shafts 9, 10 and 11. In the drawings, shaft 10 is shown with an extended end portion on which the operating handle is mounted. To operate the valve assembly of this invention, the operating handle is adjusted to rotate shaft 10, closure element 7 and crank 16 to the desired angle and the drive arm means transmits the rotary motion to fix the other cranks and closure elements at the same angle.

Figure 2:
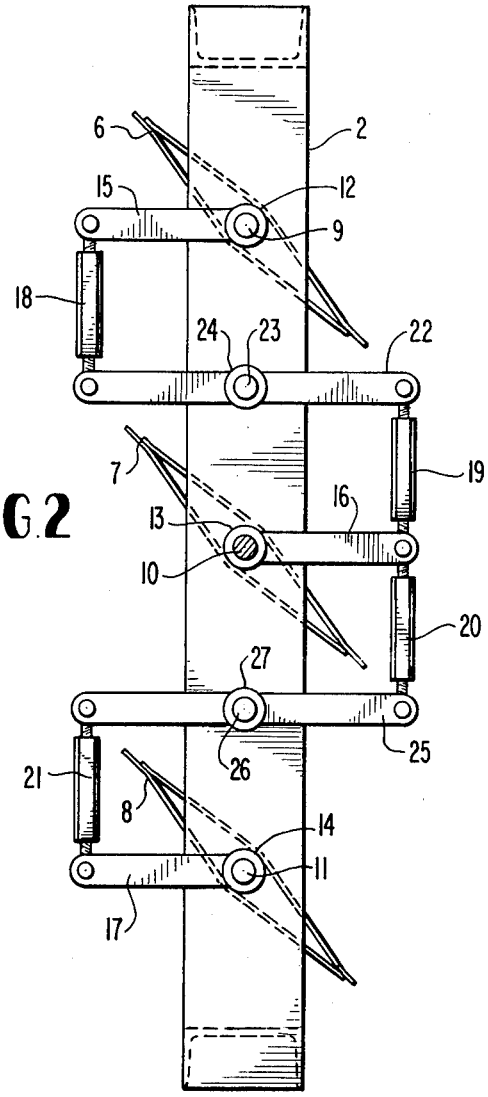
FIG. 2 is a side view of the valve assembly shown in FIG. 1 showing the closure elements in a partially open position prior to the occurrence of thermal expansion.

Closure elements 6, 7 and 8 are shown in the closed position in FIG. 1. In order to adjust the valve assembly to the partially open position shown in FIG. 2, the handle is operated to rotate shaft 10 and crank 16 in a counterclockwise direction. Rotation of crank 16 moves floating links 19 and 20 up which rotate rotating links 22 and 25 respectively. The rotation of rotating link 22 pulls floating link 18 down which rotates crank 15, shaft 9 and closure element 6 in a counterclockwise direction. The rotation of rotating link 25 pushes floating link 21 down which rotates crank 17, shaft 11 and closure element 8 in a counterclockwise direction. Rotation of shaft 10 will through the pair of three-link drive arm means adjust closure elements 6, 7 and 8 to any desired position from valve open to valve closed positions. A single three-link drive arm means of this invention, as shown in the drawings connecting cranks 15 and 16, may be used for a two closure element valve assembly and additional three-link drive arm means may be used for valve assemblies having more than three closure elements.

Figure 3:
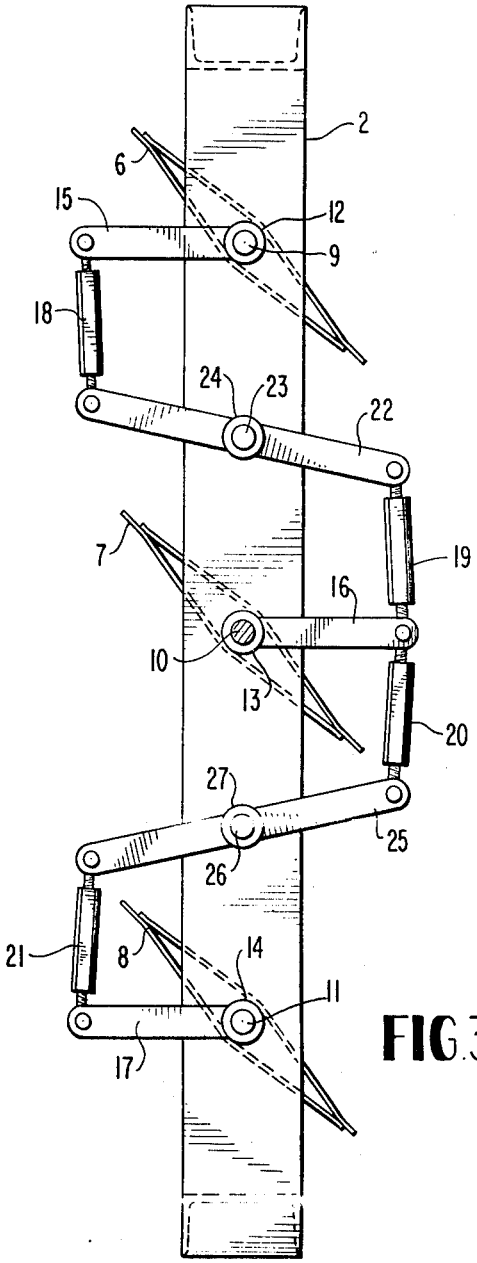
FIG. 3 is a side view of the valve assembly shown in FIG. 1 showing the closure elements in a partially open position after the occurrence of thermal expansion.

The temperature-compensating operation of the three-link drive arm means of this invention during periods of expansion and contraction of the housing will be better understood by reference to FIG. 3 which shows the relative positions of floating links 18, 19, 20 and 21 and rotating links 22 and 25 after the occurrence of thermal expansion. As housing 1 expands and shafts 9, 10 and 11 move apart, shafts 23 and 26 remain at points equidistant between shafts 9 and 10 and 10 and 11. Rotating link 22 rotates and pivots floating links 18 and 19 to compensate for the increased distance between shafts 9 and 10. Rotating link 25 rotates and pivots floating links 20 and 21 to compensate for the increased distance between shafts 10 and 11. The rotation of rotating links 22 and 25 enables each three-link drive arm means to cover the increased distance between shafts 9 and 10 and 10 and 11 respectively, without movement of cranks 15, 16 and 17 so that closure elements 6, 7 and 8 remain in the same partially open position while housing 1 expands. Opposite rotation of rotating links 22 and 25 will in like manner maintain closure elements 6, 7 and 8 in the same partially open position as housing 1 contracts when a lower temperature gas flows through the valve assembly or as the valve assembly cools. Rotation of the rotating link and pivotal movement of the floating links will thus maintain the closure elements in any desired position set by the operator by manual or powered adjustment of the operating handle during periods of thermal expansion and contraction of the housing.

What is claimed is:

1. In a valve assembly having a housing that is constructed of a material which will expand when heated, and a plurality of closure elements inside the housing that can be rotated between valve open and valve closed positions, each element being mounted on its own shaft that is journaled in the housing and has an external end portion extending through the housing, said plurality of shafts being parallel to one another and lying in the same plane at equidistant intervals, each shaft having a crank extending radially from the external end portion thereof for rotating said shaft, all of said cranks being the same length, and said plurality of cranks being linked together by drive arm means so that rotation of one of the cranks causes all of the cranks, shafts, and elements to rotate in unison, the IMPROVEMENT wherein the said drive arm means is comprised of enough three-link mechanisms to connect together all of the cranks, each said mechanism comprising a. a first floating link pivotally attached at its first end to the non-shaft end of one of the cranks, b. a second floating link of the same length as the first, pivotally attached at its first end to the non-shaft end of the next adjacent crank, and c. a rotating link pivotally mounted at its center to the housing at a point in the plane of the shafts that is equidistant between each shaft and the next adjacent shaft, one end of said rotating link being pivotally connected to the second end of one of the floating links, and the other end of said rotating link being pivotally connected to the second end of the other floating link.

2. The improvement of claim 1 wherein said closure elements are airfoils.

3. The improvement of claim 1 wherein said housing is comprised of four flanged channels rigidly secured together to form a rectangle.

4. The improvement of claim 1 wherein said rotating link is twice the length of each crank.

5. The improvement of claim 1 wherein each of said cranks and floating links is equal in length.

6. In a valve assembly having a housing that is constructed of a material which will expand when heated and that comprises four flanged channels rigidly secured together to form a rectangle, and a plurality of airfoils inside the housing that can be rotated between valve open and valve closed positions, each airfoil being mounted on its own shaft that is journaled in the housing and has an external end portion extending through the housing, said plurality of shafts being parallel to one another and lying in the same plane at equidistant intervals, each shaft having a crank extending radially from the external end portion thereof for rotating said shaft, all of said cranks being the same length, and said plurality of cranks being linked together by drive arm means so that rotation of one of the cranks causes all of the cranks, shafts, and airfoils to rotate in unison, the IMPROVEMENT wherein the said drive arm means is comprised of enough three-link mechanisms to connect together all of the cranks, each said mechanism comprising a. a first floating link pivotally attached at its first end to the non-shaft end of one of the cranks and equal in length to each of the cranks, b. a second floating link of the same length as the first, pivotally attached at its first end to the non-shaft end of the next adjacent crank, and c. a rotating link equal to twice the length of each crank and pivotally mounted at its center to the housing at a point in the plane of the shafts that is equidistant between each shaft and the next adjacent shaft, one end of said rotating link being pivotally connected to the second end of one of the floating links, and the other end of said rotating link being pivotally connected to the second end of the other floating link.

* * * * *